United States Patent [19]

Eckert

[11] 4,360,162

[45] Nov. 23, 1982

[54] FUEL INJECTION NOZZLE WITH CONTROLLED CROSS-SECTION OF INJECTION FOR INTERNAL COMBUSTION ENGINES

[75] Inventor: Konrad Eckert, Stuttgart, Fed. Rep. of Germany

[73] Assignee: Robert Bosch GmbH, Stuttgart, Fed. Rep. of Germany

[21] Appl. No.: 134,820

[22] Filed: Mar. 28, 1980

[30] Foreign Application Priority Data

May 18, 1979 [DE] Fed. Rep. of Germany ..... 2920100

[51] Int. Cl.[3] ..... B05B 1/30

[52] U.S. Cl. ..... 239/533.4

[58] Field of Search ..... 239/533.2, 533.12, 600; 29/157 C

[56] References Cited

U.S. PATENT DOCUMENTS 3,384,308 5/1968 Cupler ..... 239/600

4,069,978 1/1978 Moussa ..... 239/533.2

FOREIGN PATENT DOCUMENTS 217250 9/1961 Australia ..... 239/533.4

*Primary Examiner*—John J. Love

*Assistant Examiner*—Gene A. Church

*Attorney, Agent, or Firm*—Edwin E. Greigg

[57] ABSTRACT

The nozzle body of a fuel injection nozzle comprises upper and lower portions which are secured together by welding. This connection is achieved by using the extremity of pin means on the valve needle as a centering element. The surfaces which cooperate with the valve needle at most only need to be equalized.

1 Claim, 1 Drawing Figure

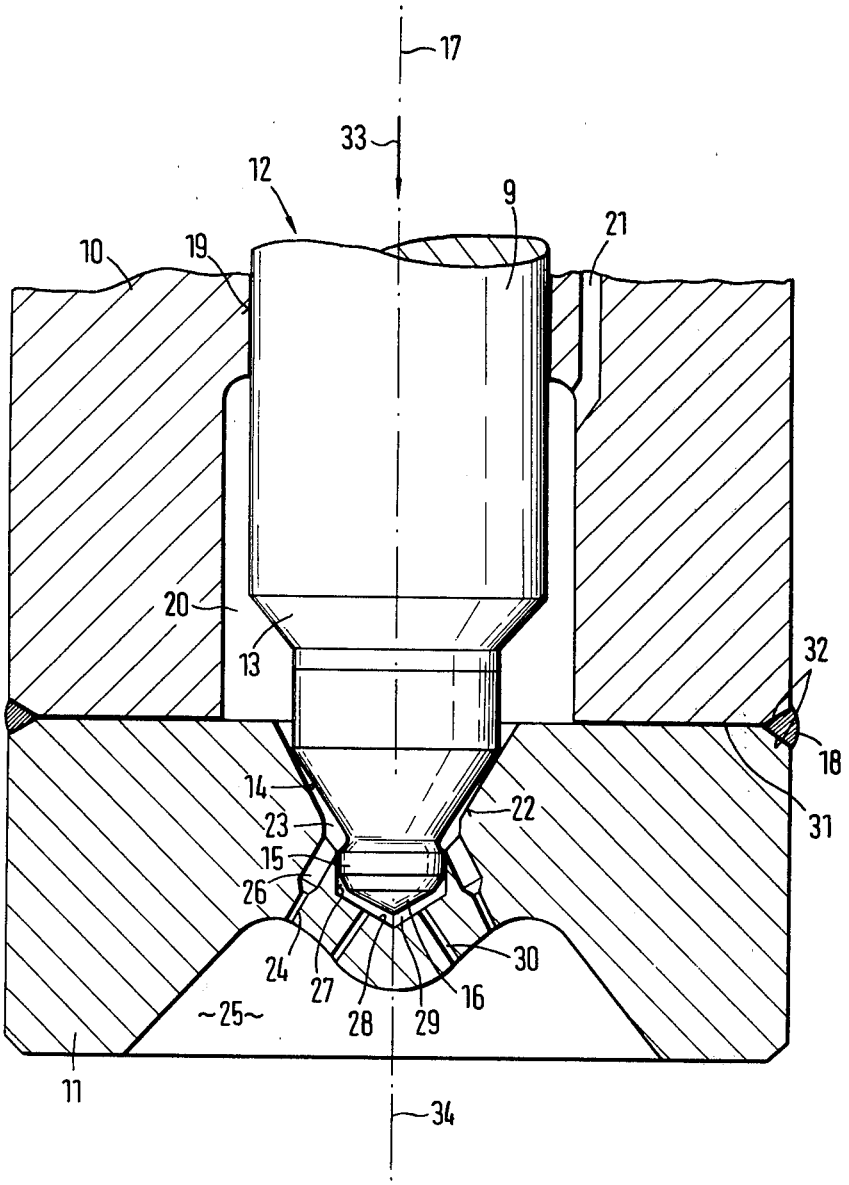
17
33
12
9
21
10
19
20
13
32
18
31
14
23
22
15
26
24
27
28
29
16
30
~25~
11
34

FUEL INJECTION NOZZLE WITH CONTROLLED CROSS-SECTION OF INJECTION FOR INTERNAL COMBUSTION ENGINES

BACKGROUND OF THE INVENTION

The invention relates to a fuel injection nozzle. The nozzle body is manufactured by a cutting process, while the guide bore and the valve seat are manufactured by a process of straight-line lapping. This manufacture requires several lapping procedures using lapping-sticks of various sizes in order to attain coaxiality, particularly of the guide bore with respect to the valve seat. These procedures are time consuming and require the skill of qualified technicians.

OBJECT AND SUMMARY OF THE INVENTION

The invention is based on the concept of having both the housing and the front part thereof manufactured separately and then joined together, whereby an associated nozzle needle is introduced into the housing and is pressed against the valve seat of the front part, so that the guide bore and the bore or cutoff port align without a face runout, i.e., no leaks can occur between the abutting portions 10 and 11. This optimal coordination between the housing and the front part thereof is secured by bracing, in order to connect both parts together so that they will not separate and will naturally be leak proof.

It is a primary object of the invention to discard the finishing process of lapping by stages. In the most unfavorable cases these surfaces need only be levelled.

Further advantageous embodiments of the invention are described herein. A development of the injection nozzle shows a kind of connection which is inseparable and prevents a distortion of the nozzle body. If the injection nozzle is further developed, the length of the injection port can be easily varied.

The invention will be better understood and further objects and advantages thereof will become more apparent from the ensuing detailed description of a preferred embodiment taken in conjunction with the drawing.

BRIEF DESCRIPTION OF THE DRAWING

The drawing shows the nozzle needle in elevation and the housing or nozzle body in axial cross-section on an enlarged scale.

DESCRIPTION OF THE PREFERRED EMBODIMENT

The drawing is an enlarged view of a portion of a nozzle body having upper and lower portions 10, 11, respectively, and of an axially symmetrical valve needle 12 which cooperates with said nozzle body. The valve needle has a shaft 9, a stop 13 in the shape of a truncated cone, a valve cone 14, a cylindrical pin 15 attached thereto and a needle point 16. The valve needle 12 is made of hardened steel and has a refined surface with a tolerance of a few thousandths of a millimeter within the guide area. The rotational axis is given the reference numeral 17.

The nozzle body consists of the housing 10 and the front part 11 thereof which are also made of hardened steel and are joined together by a welding point 18 so that they cannot separate. The housing 10 has a guide bore 19, which cooperates with the shaft 9 of the valve needle 12, and a torus 20 receiving the stop 13, into which empties a high-pressure fuel delivery line 21.

A valve seat 22 having the shape of a truncated cone is disposed within the front part 11 and is associated with the valve cone 14 to form and control a first pressure chamber 23. Leaving from chamber 23, several injection ports 24 lead into the combustion chamber 25 of the internal combustion engine, and each of them has a countersunk area 26 which begins in the pressure chamber 23.

A cylindrical bore or cutoff port 27, which cooperates with the periphery of the pin 15, extends into a depressed zone 28 which is in the shape of a truncated cone which cooperates with the terminus of the needle point 16 to form a second pressure chamber 29, from which again several injection ports 30 lead into the combustion chamber 25.

The lower end face of the housing 10 and the upper face of the front part 11 lie in exact abutment against one another in the plane indicated at 31, and the abutting surfaces have a scarf joint 32 for the welding zone 18. In order to attach both surfaces together so that they do not separate, one can use either electron beam welding or laser beam welding. The division line 31 lies, it will be observed, above the valve seat 22 as well as the pressure chamber 29.

The following is a description of how the nozzle body is assembled:

The housing 10 and the lower front part 11 thereof are brought into abutting contact on the line 31. Then the valve needle 12 is pushed down into the guide bore 19 until the valve cone 14 of said needle comes to rest on the valve seat 22 and the peripheral wall of pin 15 projects into the bore or cutoff port 27. The valve needle 12 is thereupon pressed axially, according to arrow 33, against the front part 11, which results in the axis 17 of the valve needle 12 and the axis 34 of the cutoff port being in alignment, i.e., the coaxiality of both axes has then been achieved. This optimal relation between the housing 10 and the front part 11 is secured by their being braced together and their having each a scarfing joint point for welding as shown at 18, as indicated above.

Since there is practically no risk of a face runout, as explained earlier herein, with the axes 17 and 34 being in alignment, in general there is no need for a final machining of the cooperating parts.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle having a controlled cross-section of injection for internal combustion engines, comprising, a nozzle body, said nozzle body including separate upper and lower smooth planar faced body portions, said upper and lower body portions including axially aligned guide bores, said guide bore in said lower body portion including a valve seat having the shape of a truncated cone in combination with a cylindrical bore and a conical depressed zone, a needle valve having a valve cone in said truncated cone guide bore and a pin means on an extremity thereof, said nozzle body forming with said valve cone a first pressure chamber with first injection ports, said first injection ports including a cylindrical countersunk linear portion extending from said first pressure chamber, said first injection ports being controlled by said valve cone of said needle valve, a second pressure chamber formed by said pin means on said needle valve and said conical depressed zone in said lower body portion, said second pressure chamber being provided with second injection ports, characterized in that said nozzle body upper and lower smooth planar faced portions are welded together with their smooth faces adjacent each other.

* * * * *